US011027402B2

(12) United States Patent
Chuang

(10) Patent No.: US 11,027,402 B2
(45) Date of Patent: Jun. 8, 2021

(54) TORQUE SOCKET HAVING TORQUE VALUE INDICATION

(71) Applicant: Wei-Chieh Chuang, New Taipei (TW)

(72) Inventor: Wei-Chieh Chuang, New Taipei (TW)

( * ) Notice: Subject to any disclaimer, the term of this patent is extended or adjusted under 35 U.S.C. 154(b) by 312 days.

(21) Appl. No.: 16/383,581

(22) Filed: Apr. 13, 2019

(65) Prior Publication Data

US 2019/0321948 A1 Oct. 24, 2019

(30) Foreign Application Priority Data

Apr. 23, 2018 (TW) ..... 107205272

(51) Int. Cl.
*B25B 23/142* (2006.01)
*B25B 13/06* (2006.01)
*B25B 23/16* (2006.01)

(52) U.S. Cl.
CPC ..... *B25B 23/1427* (2013.01); *B25B 13/06* (2013.01); *B25B 23/16* (2013.01)

(58) Field of Classification Search
CPC ... B25B 23/142; B25B 23/1427; B25B 23/16; B25B 23/141; B25B 23/1422; B25B 13/06
See application file for complete search history.

(56) References Cited

U.S. PATENT DOCUMENTS 5,813,298 A * 9/1998 Beattie ..... B25B 23/1427 81/475
8,122,794 B2 * 2/2012 Lai ..... B25B 23/1427 81/475
8,359,955 B2 * 1/2013 Deneault ..... B25B 23/1427 81/474
8,365,641 B2 * 2/2013 Daglow ..... B25B 23/1427 81/476
8,973,475 B2 * 3/2015 Lai ..... B25B 15/00 81/475
10,596,687 B2 * 3/2020 Chuang ..... B25B 23/147
2011/0232431 A1 * 9/2011 Deneault ..... B25B 23/1427 81/474
2014/0000420 A1 * 1/2014 Chuang ..... B25B 23/141 81/475
2019/0344369 A1 * 11/2019 Lin ..... B23G 1/16
2020/0298383 A1 * 9/2020 Huang ..... B25B 13/06

FOREIGN PATENT DOCUMENTS

TW M373255 U1 2/2010

* cited by examiner

*Primary Examiner* — David B. Thomas
(74) *Attorney, Agent, or Firm* — Guice Patents PLLC

(57) ABSTRACT

A torque socket having torque value indication, includes: a main body, one side thereof axially disposed with an insertion part and another side thereof axially formed with an accommodation slot, wherein at least one guiding tenon and an indication ring are radially and axially disposed on an outer circumference of the accommodation slot respectively, an outer circumference of the indication ring is annularly provided with torque value marks; a torque adjusting assembly, including a spring and a shaft cylinder, wherein an outer circumference of shaft cylinder is radially formed with an arc-shaped guiding slot allowing the guiding tenon to be inserted, the shaft cylinder can axially compress the spring for adjusting a torque value; and an end cover ring, having an indication mark at an outer circumference thereof. Accordingly, the indication mark can be aimed at one of the torque value marks for displaying a locking torque value.

12 Claims, 6 Drawing Sheets

A-A

TORQUE SOCKET HAVING TORQUE VALUE INDICATION

BACKGROUND OF THE INVENTION

1. Field of the Invention

The present invention relates to a torque socket, especially to a torque socket having torque value indication.

2. Description of Related Art

A conventional screwdriver is mainly constituted of a handgrip and a drive rod having a drive head; the drive head is formed in a flat shape or a cross shape for matching with a flat recess or a cross recess formed at the top of a screw, so that the screw can be fastened or released. Because the shape and the dimension of the drive head of the screwdriver is fixed, another drive head having a different shape and dimension cannot be used for replacement.

In view of the above-mentioned disadvantage, the skilled people in the art have developed a hand tool, for example a wrench, allowing the drive head to be replaced; after the wrench is sleeved with a socket, the bottom end of the sleeve is formed with an insertion slot allowing the drive head having different shape and dimension to be inserted, thereby being suitable to be applied to screws with various specifications. However, the sleeve is only served as a toque transferring tool, and there is no torque mechanism provided to the sleeve.

Therefore, the skill people in the art have developed a torque socket have a function of adjusting torque value, the Taiwan Patent Registration No. M373255 has disclosed a torque socket including a main body, a torque adjusting set disposed in the main body and a drive set. One end of the main body is formed with a linkage slot, an accommodation slot is formed in the main body, an inner wall of the accommodation slot is axially formed with a limiting part; the torque adjusting set is used for adjusting a stretching status of a spring so as to adjust the torque value, and the drive set has a tool driving cylinder, a passive seat abutted against the spring, one end of the tool driving cylinder has a push slot which is driven by a hand tool, an end surface at another end thereof is formed with a plurality of concave slots which are annularly arranged, a circumference of the passive seat is formed with a plurality of protrusions which are annularly arranged and received in the concave slots, so that an engaging status can be formed between the tool driving cylinder and the passive seat. Moreover, an outer side of the passive seat is formed with a positioning part which is corresponding to the limiting part and latched with the limiting part, so that the positioning part is able to be axially displaced along the limiting part.

However, when a torque value exceeds a preset torque value of the above-mentioned torque socket, the concave slots of the tool driving cylinder would be released from the protrusions of the passive seat, the engaging status of the tool driving cylinder and the passive seat is no longer maintained, and an idle rotation status is formed, but a real torque value, for example 3 Nm(Newton-meter), while being tightly locked cannot be truly displayed. As such, the above-mentioned disadvantages shall be improved.

SUMMARY OF THE INVENTION

One primary objective of the present invention is to provide a torque socket, which has an advantage of timely displaying a torque value in a screw locking process, so that a situation of an objected to be locked exceeding a preset tightness can be prevented.

For achieving said objective, one technical solution provided by the present invention is to provide a torque socket having torque value indication, which includes: a main body, one side thereof axially disposed with an insertion part allowing a rotation tool to be inserted and another side thereof axially formed with an accommodation slot, wherein a combination hole is formed in the accommodation slot, at least one guiding tenon is radially disposed on an outer circumference of the accommodation slot, and an indication ring is axially fastened on the outer circumference of the accommodation slot, an outer circumference of the indication ring is annularly provided with a plurality of torque value marks; a torque adjusting assembly, including a spring and a shaft cylinder disposed in the accommodation slot, wherein the spring is disposed between an inner wall of the accommodation slot and the shaft cylinder, one side of the shaft cylinder is formed with a sleeve slot protruded out from the indication ring and allowing a drive head to be sleeved, and an outer circumference of shaft cylinder is radially formed with a segment of arc-shaped guiding slot arranged at a location corresponding to the guiding tenon and allowing the guiding tenon to be inserted; a connecting member is utilized for passing the sleeve slot and the spring and received in the combination hole, the shaft cylinder is able to axially compress the spring for adjusting a torque value; and an end cover ring, combined at the outer circumference of the accommodation slot, wherein an indication mark is formed at an outer circumference of the end cover ring; when an object to be locked is fastened and locked by the drive head, the guiding tenon of the main body is displaced along the arc-shaped guiding slot of the shaft cylinder, a part of the shaft cylinder is retracted into the accommodation slot, a part of the end cover ring is retracted into the indication ring, and the shaft cylinder is served to compress the spring, so that the indication mark is aimed at one of the torque indication marks for displaying a locking torque value of the object to be locked.

For achieving said objective, another technical solution provided by the present invention is to provide a torque socket having torque value indication, which includes: a main body, one side thereof axially disposed with an insertion part allowing a rotation tool to be inserted and another side thereof axially formed with an accommodation slot, wherein a combination hole is formed in the accommodation slot, at least one guiding tenon and a hollow slot are radially disposed on an outer circumference of the accommodation slot, and an indication ring capable of shielding the hollow slot is axially fastened on the outer circumference of the accommodation slot, an outer circumference of the indication ring is annularly provided with a plurality of torque value marks; a torque adjusting assembly, including a spring and a shaft cylinder disposed in the accommodation slot, wherein the spring is disposed between an inner wall of the accommodation slot and the shaft cylinder, one side of the shaft cylinder is formed with a sleeve slot protruded out from the indication ring and allowing a drive head to be sleeved, and an outer circumference of shaft cylinder is radially formed with a segment of arc-shaped guiding slot arranged at a location corresponding to the guiding tenon and allowing the guiding tenon to be inserted, the shaft cylinder further includes a torque fine tuning device which has a shaft tube axially extended in a direction opposite to the sleeve slot, an outer circumference of the shaft tube is formed with an adjusting thread segment, an adjusting ring is threaded with the adjusting thread segment, so that the adjusting ring is arranged to be adjacent to the spring, the adjusting ring is located in the hollow slot, and an outer circumference of the adjusting ring is annularly formed with a plurality of rod holes allowing a pry tool to be inserted; a connecting member is utilized for passing the sleeve slot and the spring and received in the combination hole, the adjusting ring is able to axially compress or release the spring for adjusting a torque value; and an end cover ring, combined at the outer circumference of the accommodation slot, wherein an indication mark is formed at an outer circumference of the end cover ring; when an object to be locked is fastened and locked by the drive head, the guiding tenon of the main body is displaced along the arc-shaped guiding slot of the shaft cylinder, a part of the shaft cylinder is retracted into the accommodation slot, a part of the end cover ring is retracted into the indication ring, and the adjusting ring is served to compress the spring, so that the indication mark is aimed at one of the torque indication marks for displaying a locking torque value of the object to be locked.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
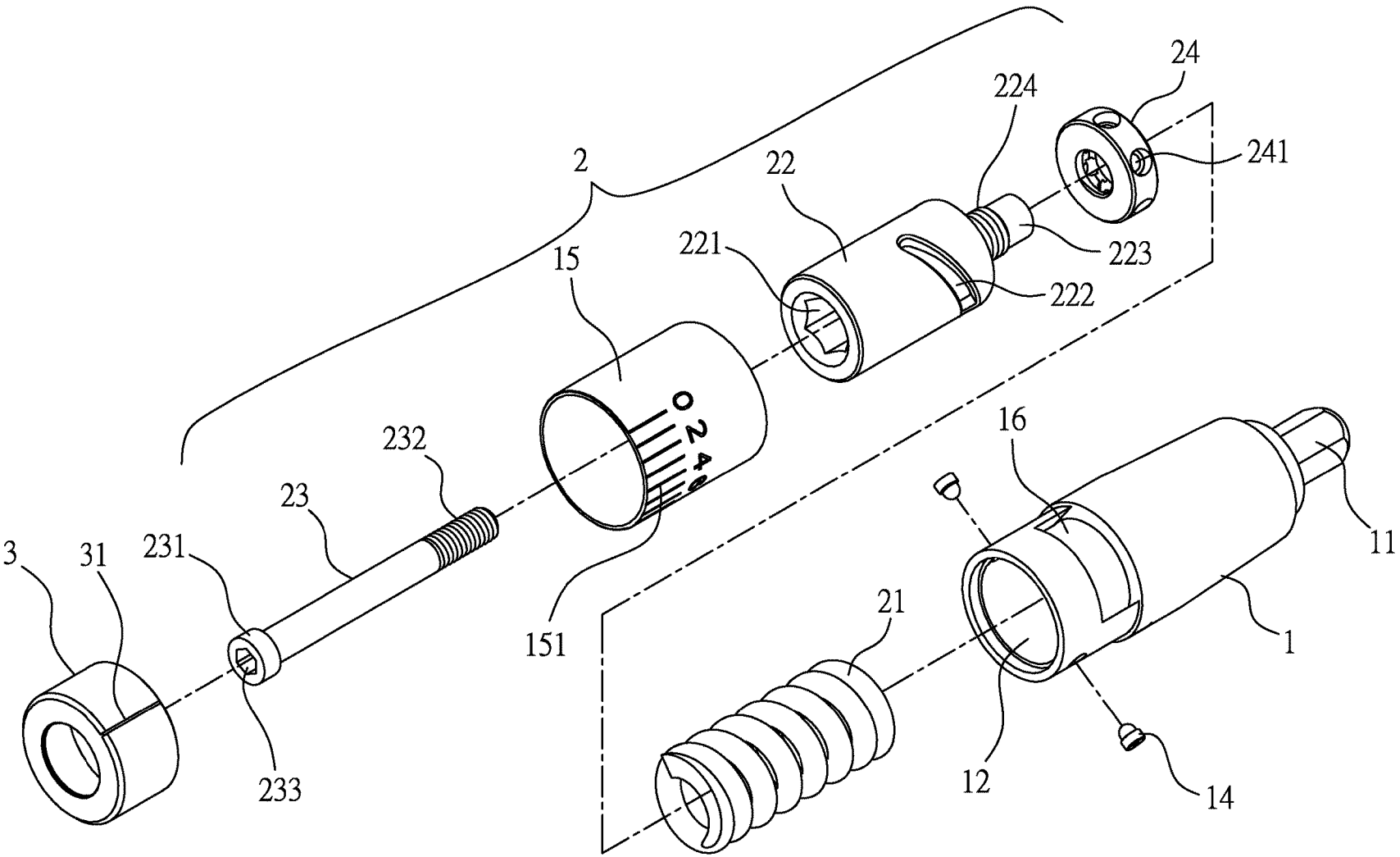
FIG. 1 is a perspective exploded view illustrating a torque socket according to the present invention.

Please refer from FIG. 1 to FIG. 4*b*, the present invention provides a torque socket having a main body 1, a torque adjusting assembly 2 and an end cover ring 3.

The main body 1 is formed in a hollow cylindrical shape, one side, for example a right side, thereof is axially disposed with an insertion part 11, for example an insertion tenon, the insertion tenon is a columnar member having a non-circular, for example hexagonal, cross section so as to be inserted in an insertion hole 41 of a rotation tool (shown in FIG. 5), thereby enabling the main body 1 to be rotated with the rotation tool 4. According to other embodiments, the insertion part 11 can be an insertion hole having a non-circular cross section, the insertion hole allows an insertion tenon, for example a hexagonal wrench, correspondingly disposed on the rotation tool 4 to be inserted, so that the main body 1 can be rotated with the rotation tool 4.

Figure 2:
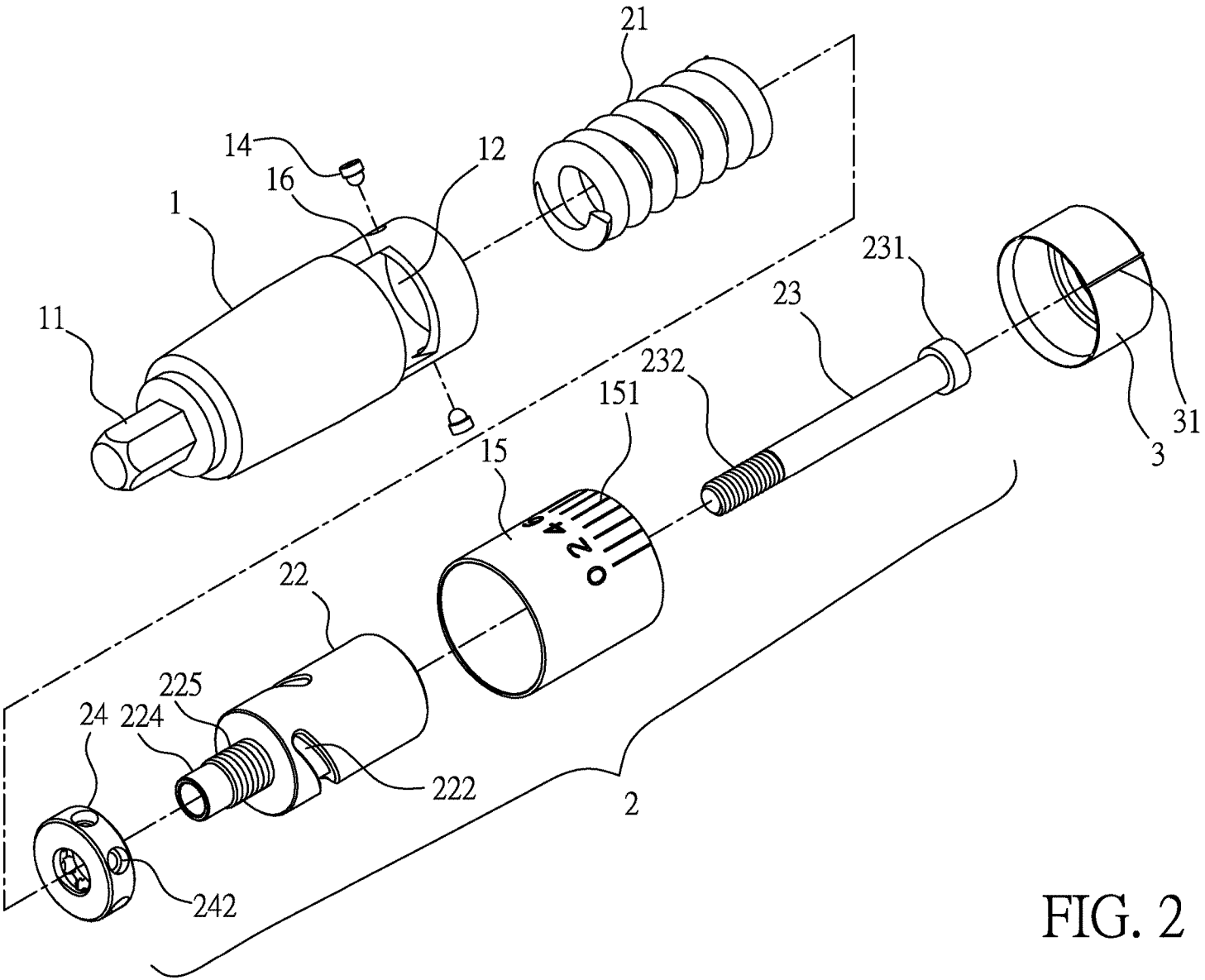
FIG. 2 is another perspective exploded view illustrating the torque socket according to the present invention.
Figure 4A:
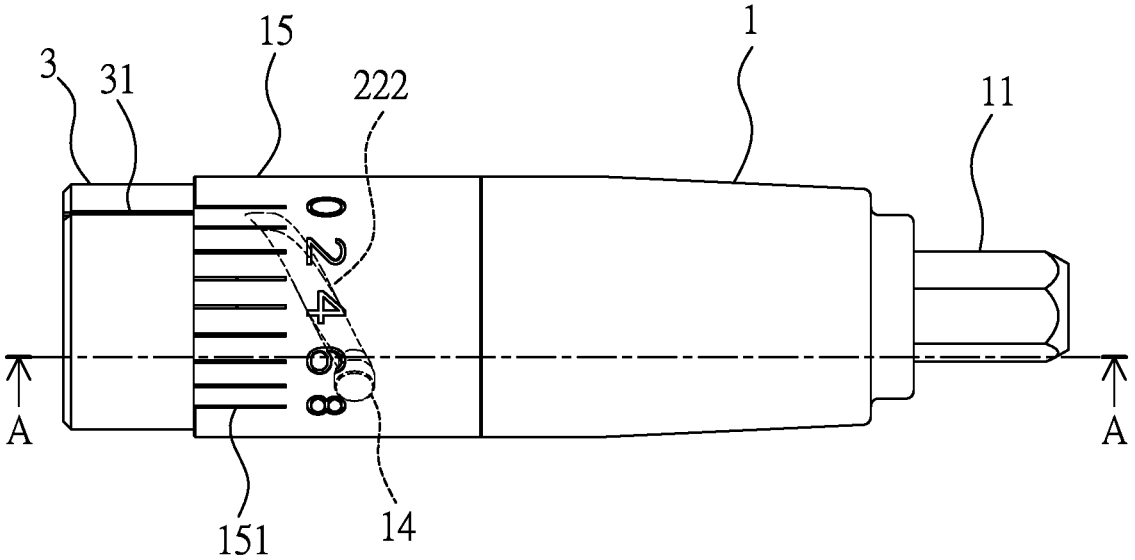
FIG. 4*a* is a front view illustrating the torque socket being in a non-operating status according to the present invention.
Figure 4B:
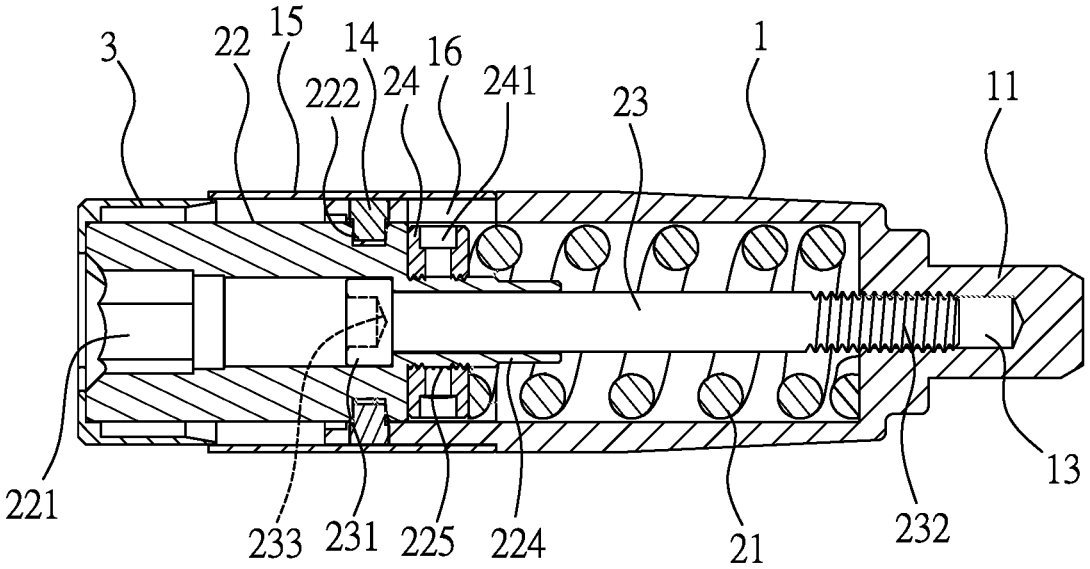
FIG. 4*b* is a cross sectional view illustrating the torque socket being in the non-operating status according to the present invention.
Figure 6A:
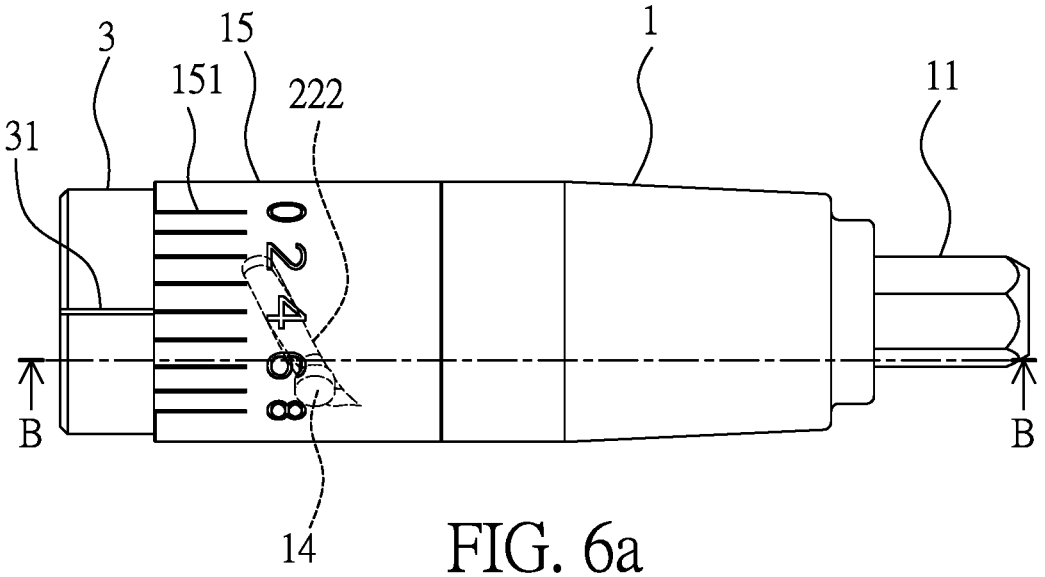
FIG. 6*a* is a front view illustrating the torque socket being in an operating status according to the present invention.
Figure 6B:
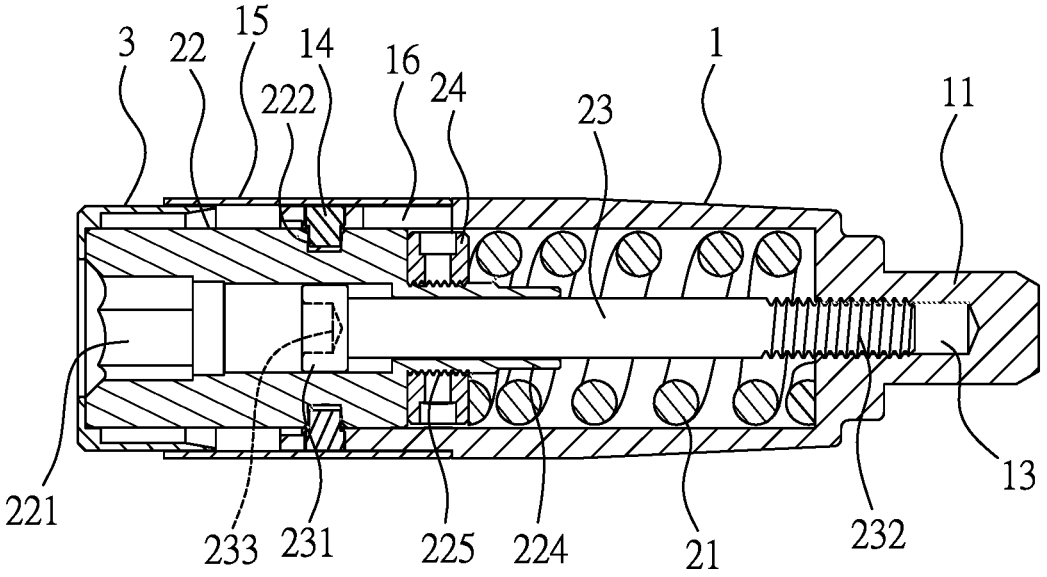
FIG. 6*b* is a cross sectional view illustrating the torque socket being in the operating status according to the present invention.

An accommodation slot 12 is axially formed at another side (for example a left side) of the main body 1, thus the torque adjusting assembly 2 can be accommodated therein, a combination hole 13 (as shown in FIG. 4*b* and FIG. 6*b*) is axially formed in the accommodation slot 12, at least one guiding tenon 14 is radially disposed at an outer circumference of the accommodation slot 12, as shown in FIG. 1 and FIG. 2, there are two guiding tenons 14 which are preferably to be oppositely and radially disposed on the outer circumference of the accommodation slot 12.

Moreover, for providing an indication of a torque value, an indication ring 15 is fastened, for example adhered or screwed, on the outer circumference of the accommodation slot 12, an outer circumference of the indication ring 15 is provided with a plurality of torque value marks 151, for example lines, numerals, patterns or a combination of the above.

Furthermore, the outer circumference of the accommodation slot 12 is further formed with a hollow slot 16 allowing an operation of fine tuning torque to be processed.

Figure 5:
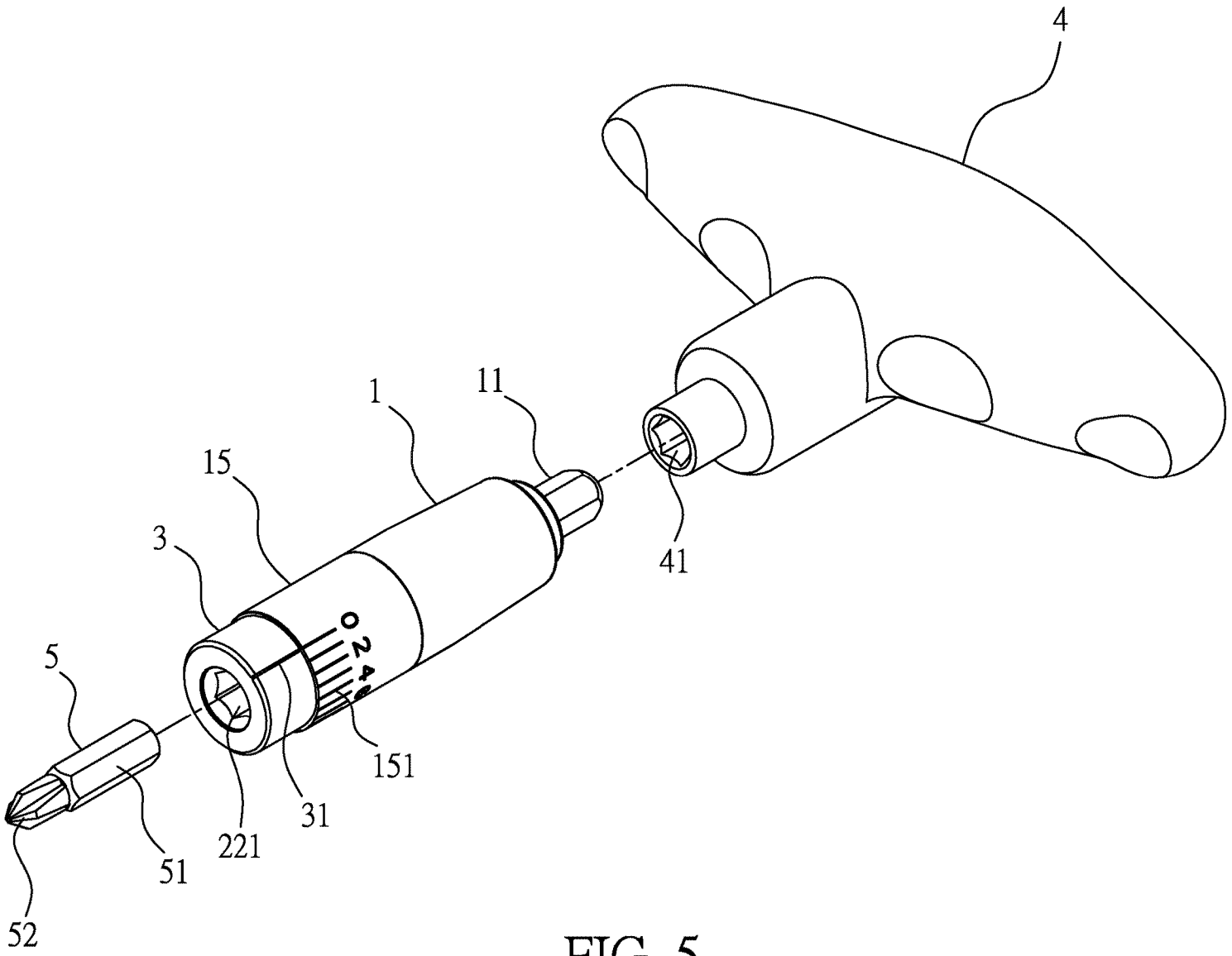
FIG. 5 is a perspective exploded view illustrating the torque socket, the rotation tool and the drive head yet being assembled according to the present invention.

The torque adjusting assembly 2 has a spring 21 and a shaft cylinder 22 sequentially disposed in the accommodation slot 12, so that two ends of the spring 21 are arranged between an inner wall of the accommodation slot 12 and the shaft cylinder 22. One side, for example a left side, of the shaft cylinder 22 is formed with a sleeve slot 221 protruded out from the indication ring 15; in practice, the sleeve slot 221 is a hole having a non-circular cross section, so that a sleeve rod 51 (as shown in FIG. 5) disposed on a drive head 5 and having a non-circular cross section can be inserted therein. Moreover, an outer circumference of shaft cylinder 22 is radially formed with a segment of arc-shaped guiding slot 222 arranged at a location corresponding to each of the guiding tenons 14 and allowing each of the guiding tenons 14 to be inserted. Then, a connecting member 23, for example a screw rod, is provided for passing the sleeve lot 221, and passing the spring 21 and screwed in the combination hole 13.

A rod head 231 and a connecting segment 232 are respectively disposed at two ends of the connecting member 23, an end surface of the rod head 231 is axially formed with a rotation hole 233 having a non-circular, for example hexagonal, cross section. When being assembled, the connecting member 23 is inserted in the sleeve slot 221 by a user, and a tool, for example an internal hexagonal wrench, is utilized for being inserted in the rotation hole 223 for rotations, so that the connecting segment 232 is screwed in the combination hole 13, and the shaft cylinder 22 is served to axially compress the spring 21 for adjusting the torque value.

As a matter of fact, the spring 21 is provided with different torques due to the diameter of the spring and the composed materials; for allowing the torque of the spring 21 to be fine tuned, the shaft cylinder 22 of the torque adjusting assembly 2 further includes a torque fine tuning device, the device has a shaft tube 223 axially extended in a direction opposite to the sleeve slot 221 and allowing the connecting member 23 to be received, an outer circumference of the shaft tube 223 is formed with an adjusting thread segment 224, an adjusting ring 24 is threaded with the adjusting thread segment 224, so that the adjusting ring 24 is arranged to be adjacent to one end of the spring 21, wherein the adjusting ring 24 is located in the hollow slot 16, and an outer circumference of the adjusting ring 24 is annularly formed with a plurality of rod holes 241 allowing a pry tool, for example a pry rod (known as a conventional round rod therefore not shown in figures), to be inserted.

When the torque of the spring 21 is desired to be fine tuned, an operator only has to insert the pry tool in one of the rod holes 242 at the location of the hollow slot 16, then the pry tool is utilized for rotating the adjusting ring 24, the adjusting ring 24 is axially displaced along the shaft tube 223, so that the spring 21 is able to be compressed or released to adjust the torque to a preset torque value, thereby enabling a real torque value to be displayed.

The end cover ring 3 is combined, for example adhered or screwed, at the outer circumference of the shaft cylinder 22, an outer circumference of the indication ring 15 is provided with an indication mark 31, for example a marking line or an arrow. The installation of the end cover ring 3 is to enable the indication mark 31 to be aimed at one of the torque value marks 151, thus a real torque value can be clearly indicated when a screw is tightly screwed, and the indication ring 15 is served to shield the hollow slot 16, so that a situation of the adjusting ring 24 being wrongly adjusted by a manual force can be prevented, and the accuracy of the indicated torque value can be ensured.

Moreover, an outer circumference of the end cover ring 3 is arranged to be adjacent to an opening of the indication ring 15, so that an oil storing space 32 (as shown in FIG. 4*b* and FIG. 6*b*) is formed between the end cover ring 3 and the shaft cylinder 22, the oil storing space 32 is used for storing lubricating oil overflowing from the arc-shaped guiding slot 222, thereby preventing the lubricating oil from leaking out.

Figure 3:
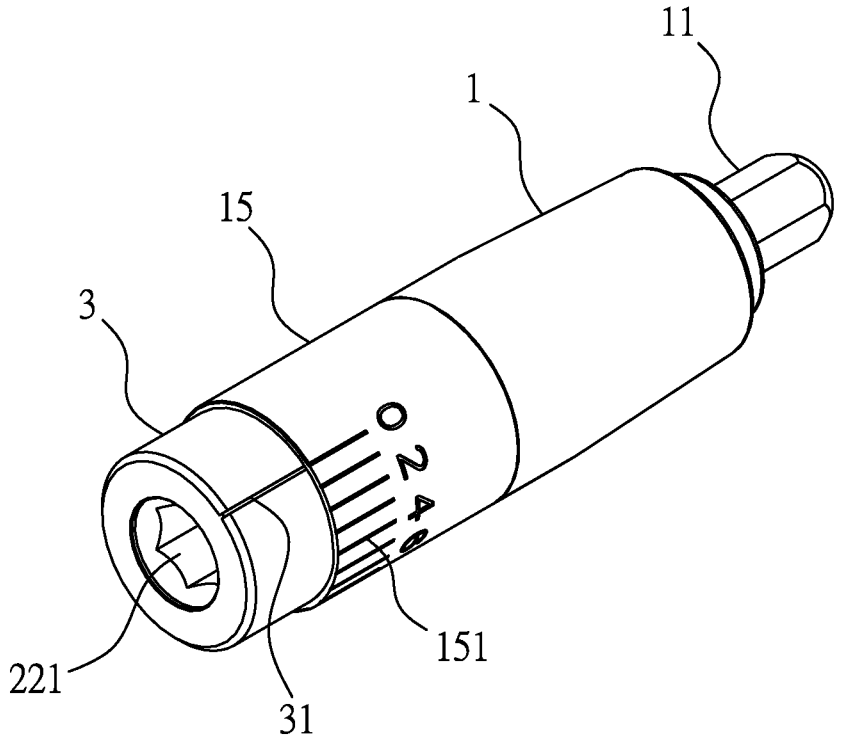
FIG. 3 is a perspective view illustrating the assembly of the torque socket of FIG. 1 according to the present invention.

The assembly of the torque socket is shown in FIG. 3, and FIG. 4*a* and FIG. 4*b* are a front view and a cross sectional views illustrating the torque socket being in a non-operating status according to the present invention; in the cross sectional view, the arrangement of the torque adjusting assembly 2 being in the indication ring 15 and the accommodation slot 12 can be clearly observed, the spring 21 can be compressed or released through the adjusting ring 24 being axially displaced in the shaft tube 223, thereby allowing an operation of adjusting the torque valve to an accurate preset torque valve to be processed.

Please refer to FIG. 5, before the torque socket is operated, the insertion part 11 is inserted in the rotation tool 4, for example a handgrip hole 41 at the bottom end of a screwdriver handgrip, the sleeve slot 221 of the shaft cylinder 22 is served to allow the sleeve rod 51 of the selected drive head 5 to be sleeved therein; in practice, one end of the sleeve rod 51 can be an operation head 52 having a certain shape (for example but not limited to a flat shape, cross shape or other geometric shapes), the above-mentioned is known as prior art, therefor no further illustration is provided.

Please refer to FIG. 6*a* and FIG. 6*b*, when a locking operation is desired to be processed (the rotation tool 4 and the drive head 5 are not shown in figures for the purpose of providing a clear disclosure), the operation head 52 of the drive head 5 is aimed at an object to be locked, for example a top recess of at least one screw disposed in a bottle holder of a bicycle, then the rotation tool 4 is rotated by a hand of the user for enabling the main body 1 to drive the shaft cylinder 22, the drive head 5 and the screw to be synchronously rotated, so that the screw is able to pass a through hole formed on the bottle holder of the bicycle, and locked on a frame of the bicycle; during the screwing process, the screw is able to be continuously screwed into the frame of the bicycle, when the screw is rotated and positioned (being tightly locked), the at least one guiding tenon 14 of the main body 1 is displaced along the arc-shaped guiding slot 222 of the shaft cylinder 22, in other words the main body 1 is rotated and the shaft cylinder 22 is in an axially displacing status, thus a part of the shaft cylinder 22 is retracted into the accommodation slot 12, a part of the end cover ring 3 is retracted into the indication ring 15, and the adjusting ring 24 is served to compress the spring 21 (storing energy), the indication mark 31 of the end cover ring 3 is aimed at one of the torque indication marks 151 (for example a line marked as the numeral 4) of the indication ring 15, and the locking torque value of the screw is defined as 4 Nm(Newton-meter).

When the drive head 5 is released from the screw, the spring 21 is served to release energy for enabling the at least one guiding tenon 14 of the main body 1 to be reversely displaced along the arc-shaped guiding slot 222 of the shaft cylinder 22, so that a part of the shaft cylinder 22 is protruded out from the accommodation slot 12, the end cover ring 3 is protruded out from the indication ring 15, thereby allowing the torque adjusting assembly 2 to be recovered to the non-operating status as shown in FIG. 3, FIG. 4*a* and FIG. 4*b*, and the indication mark 31 is aimed at one of the torque value marks 151, for example a line marked as the numeral 0, of the indication ring 15, and the torque value is defined as 0 Nm(Newton-meter).

Based on what has been disclosed above, advantages achieved by the present invention are as follows. When the object to be locked is in a tightly locked status, the at least one guiding tenon of the main body is displaced along the arc-shaped guiding slot correspondingly formed in the shaft cylinder, and a part of the shaft cylinder is retracted into the accommodation slot, the shaft cylinder or the adjusting ring is served to compress the spring, so that the indication mark of the end cover ring can be aimed at one of the torque value marks of the indication ring, thereby allowing the locking torque value of the object to be locked to be displayed. Moreover, the connecting member of the torque socket is utilized for passing the shaft cylinder and the spring then being screwed in the combination hole of the main body, so that the shaft cylinder is able to axially compress the spring for adjusting the torque valve; furthermore, the shaft cylinder further includes the torque fine tuning device, for example the adjusting ring being screwed in the shaft tube axially protruded from the shaft cylinder, then the adjusting ring being arranged to be adjacent to the spring for enabling the adjusting ring to compress or release the spring so as to adjust the torque value to the accurate preset torque value. Accordingly, the torque socket having torque value indication provided by the present invention is novel and more practical in use comparing to prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A torque socket having torque value indication, including:

a main body, one side thereof axially disposed with an insertion part allowing a rotation tool to be inserted and another side thereof axially formed with an accommodation slot, wherein a combination hole is formed in said accommodation slot, at least one guiding tenon is radially disposed on an outer circumference of said accommodation slot, and an indication ring is axially fastened on said outer circumference of said accommodation slot, an outer circumference of said indication ring is annularly provided with a plurality of torque value marks;

a torque adjusting assembly, including a spring and a shaft cylinder disposed in said accommodation slot, wherein said spring is disposed between an inner wall of said accommodation slot and said shaft cylinder, one side of said shaft cylinder is formed with a sleeve slot protruded out from said indication ring and allowing a drive head to be sleeved, and an outer circumference of said shaft cylinder is radially formed with at least one arc-shaped guiding slot arranged at at least one location corresponding to said at least one guiding tenon and allowing said at least one guiding tenon to be inserted; a connecting member is utilized for passing said sleeve slot and said spring and received in said combination hole, so that said shaft cylinder is able to axially compress said spring for adjusting a torque value; and an end cover ring, combined at said outer circumference of said accommodation slot, wherein an indication mark is formed at an outer circumference of said end cover ring;

when an object to be locked is fastened and locked by said drive head, said at least one guiding tenon of said main body is displaced along said arc-shaped guiding slot of said shaft cylinder, a part of said shaft cylinder is retracted into said accommodation slot, a part of said end cover ring is retracted into said indication ring, and said shaft cylinder is served to compress said spring, so that said indication mark is aimed at one of said plurality of torque indication marks for displaying a locking torque value of said object to be locked.

2. The torque socket having torque value indication as claimed in claim 1, wherein said insertion part is an insertion tenon having a non-circular cross section, or said insertion part is an insertion hole having a non-circular cross section.

3. The torque socket having torque value indication as claimed in claim 1, wherein there are two guiding tenons which are oppositely and radially disposed at said outer circumference of said accommodation slot.

4. The torque socket having torque value indication as claimed in claim 1, wherein said outer circumference of said end cover ring is arranged to be adjacent to an opening of said indication ring, so that an oil storing space used for storing lubricating oil is formed between said end cover ring and said shaft cylinder.

5. The torque socket having torque value indication as claimed in claim 1, wherein said sleeve slot is a hole having a non-circular cross section.

6. The torque socket having torque value indication as claimed in claim 1, wherein said indication mark is a marking line or an arrow, and torque value marks are lines, numerals, patterns or a combination thereof.

7. A torque socket having torque value indication, including:

a main body, one side thereof axially disposed with an insertion part allowing a rotation tool to be inserted and another side thereof axially formed with an accommodation slot, wherein a combination hole is formed in said accommodation slot, at least one guiding tenon and a hollow slot are radially disposed and formed on an outer circumference of said accommodation slot, and an indication ring capable of shielding said hollow slot is axially fastened on said outer circumference of said accommodation slot, an outer circumference of said indication ring is annularly provided with a plurality of torque value marks;

a torque adjusting assembly, including a spring and a shaft cylinder disposed in said accommodation slot, wherein said spring is disposed between an inner wall of said accommodation slot and said shaft cylinder, one side of said shaft cylinder is formed with a sleeve slot protruded out from said indication ring and allowing a drive head to be sleeved, and an outer circumference of said shaft cylinder is radially formed with at least one arc-shaped guiding slot arranged at at least one location corresponding to said at least one guiding tenon and allowing said at least one guiding tenon to be inserted, said shaft cylinder further includes a torque fine tuning device which has a shaft tube axially extended in a direction opposite to said sleeve slot, an outer circumference of said shaft tube is formed with an adjusting thread segment, an adjusting ring is threaded with said adjusting thread segment, so that said adjusting ring is arranged to be adjacent to said spring, said adjusting ring is located in said hollow slot, and an outer circumference of said adjusting ring is annularly formed with a plurality of rod holes allowing a pry tool to be inserted; a connecting member is utilized for passing said sleeve slot and said spring and received in said combination hole, said adjusting ring is able to axially compress or release said spring for adjusting a torque value; and an end cover ring, combined at said outer circumference of said accommodation slot, wherein an indication mark is formed at an outer circumference of said end cover ring;

when an object to be locked is fastened and locked by said drive head, said at least one guiding tenon of said main body is displaced along said arc-shaped guiding slot of said shaft cylinder, a part of said shaft cylinder is retracted into said accommodation slot, a part of said end cover ring is retracted into said indication ring, and said adjusting ring is served to compress said spring, so that said indication mark is aimed at one of said plurality of torque indication marks for displaying a locking torque value of said object to be locked.

8. The torque socket having torque value indication as claimed in claim 7, wherein said insertion part is an insertion tenon having a non-circular cross section, or said insertion part is an insertion hole having a non-circular cross section.

9. The torque socket having torque value indication as claimed in claim 7, wherein there are two guiding tenons which are oppositely and radially disposed at said outer circumference of said accommodation slot.

10. The torque socket having torque value indication as claimed in claim 7, wherein said outer circumference of said end cover ring is arranged to be adjacent to an opening of said indication ring, so that an oil storing space used for storing lubricating oil is formed between said end cover ring and said shaft cylinder.

11. The torque socket having torque value indication as claimed in claim 7, wherein said sleeve slot is a hole having a non-circular cross section.

12. The torque socket having torque value indication as claimed in claim 7, wherein said indication mark is a marking line or an arrow, and torque value marks are lines, numerals, patterns or a combination thereof.

* * * * *